US010985492B2

(12) United States Patent
Deckant et al.

(10) Patent No.: US 10,985,492 B2
(45) Date of Patent: Apr. 20, 2021

(54) CONNECTOR SHROUD CONFIGURATION

(71) Applicant: Aptiv Technologies Limited, St. Michael (BB)

(72) Inventors: David J. Deckant, Youngstown, OH (US); Sivakumar Niranjan, Nagarkurnool (IN); Rathnakumar Ramaswamy, Chennai (IN)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/517,051

(22) Filed: Jul. 19, 2019

(65) Prior Publication Data

US 2021/0021078 A1 Jan. 21, 2021

(51) Int. Cl.
*H01R 3/00* (2006.01)
*H01R 13/514* (2006.01)
*H01R 13/627* (2006.01)

(52) U.S. Cl.
CPC ..... *H01R 13/514* (2013.01); *H01R 13/6271* (2013.01)

(58) Field of Classification Search
CPC H01R 13/6272; H01R 13/465; H01R 13/641; H01R 13/65802; H01R 23/6873; H01R 23/7073
USPC .. 439/352, 488, 489, 607.01, 607.35, 607.4, 439/660
See application file for complete search history.

(56) References Cited

U.S. PATENT DOCUMENTS 4,403,824 A * 9/1983 Scott ..... H01R 13/64 439/677
5,002,497 A * 3/1991 Plocek ..... H01R 13/6315 439/247
5,131,865 A * 7/1992 Taguchi ..... H01R 13/641 439/188
5,267,882 A 12/1993 Davis
5,282,757 A 2/1994 Maeda
5,620,329 A * 4/1997 Kidd ..... H01R 13/6315 439/248
6,089,909 A * 7/2000 Tokuwa ..... H01R 13/743 439/552
6,176,738 B1 * 1/2001 Consoli ..... H01R 13/631 439/545
6,238,244 B1 * 5/2001 Yang ..... H01R 13/658 439/607.01
6,257,925 B1 * 7/2001 Jones ..... H01R 13/6273 439/357
6,935,887 B2 * 8/2005 Endo ..... H01R 13/641 439/352

(Continued)

OTHER PUBLICATIONS

Extended European Search Report for EP Application No. 20186493.1, dated Sep. 29, 2020, 15 pages.

*Primary Examiner* — Thanh Tam T Le
(74) *Attorney, Agent, or Firm* — Billion & Armitage

(57) ABSTRACT

An illustrative example embodiment of a connector includes a terminal configured to establish an electrically conductive connection with another component and a shroud surrounding the terminal. The shroud includes a first sidewall and a second sidewall that is transverse to the first sidewall. The first sidewall and the second sidewall have a sidewall dimension in a direction parallel to a longitudinal axis of the terminal. The shroud includes a first transition between the first sidewall and the second sidewall in the form of a hollow cylindrical sector having a first angular measurement of more than 90 degrees. The transition has a transition dimension that is less than the sidewall dimension.

18 Claims, 2 Drawing Sheets

(56) References Cited

U.S. PATENT DOCUMENTS 7,318,752 B2 * 1/2008 Fujimoto ..... H01R 9/03 439/660
7,399,195 B2 * 7/2008 Kim ..... H01R 13/641 439/352
7,575,454 B1 * 8/2009 Aoki ..... H01R 13/641 439/188
7,690,948 B2 * 4/2010 Lung ..... H01R 13/6582 439/607.27
7,938,688 B2 * 5/2011 Teramoto ..... H01R 13/64 439/660
8,011,969 B2 * 9/2011 Wang ..... H01R 24/60 439/660
8,066,532 B2 * 11/2011 Hou ..... H01R 13/6471 439/660
8,070,510 B2 * 12/2011 Urano ..... H01R 13/639 439/352
8,172,620 B2 * 5/2012 Su ..... H01R 13/42 439/660
8,333,616 B2 * 12/2012 Su ..... H01R 13/6581 439/660
8,393,912 B2 * 3/2013 Ko ..... H01R 13/641 439/345
8,398,439 B1 * 3/2013 Wang ..... H01R 12/57 439/660
8,535,087 B1 * 9/2013 McKee ..... H01R 13/7031 439/489
8,690,608 B2 * 4/2014 Naito ..... H01R 24/60 439/660
8,968,033 B2 * 3/2015 Little ..... H01R 13/6581 439/660
8,986,049 B2 * 3/2015 Kamarauskas ..... H01R 13/648 439/660
9,065,219 B2 * 6/2015 Naito ..... H01R 13/7033
9,325,123 B2 * 4/2016 Yu ..... H01R 13/641
9,444,202 B2 * 9/2016 Chien ..... H01R 13/6581
10,079,466 B2 9/2018 Ishaaya et al.
10,116,095 B1 10/2018 Sundarakrishnamachari et al.
10,256,569 B2 * 4/2019 Ohtaka ..... H01R 13/4367
2013/0143447 A1 * 6/2013 He ..... H01R 13/516 439/660

* cited by examiner

CONNECTOR SHROUD CONFIGURATION

BACKGROUND

Connector assemblies are useful on automotive vehicles for making electrical connections. A variety of connector configurations are known in the industry. Fuel economy and material cost are considerations that have tended to lead to lighter weight connectors. In some cases, the connector features are less robust. As a result, additional care is required when making connections using such connectors.

SUMMARY

An illustrative example embodiment of a connector includes a terminal configured to establish an electrically conductive connection with another component and a shroud surrounding the terminal. The shroud includes a first sidewall and a second sidewall that is transverse to the first sidewall. The first sidewall and the second sidewall have a sidewall dimension in a direction parallel to a longitudinal axis of the terminal. The shroud includes a first transition between the first sidewall and the second sidewall in the form of a hollow cylindrical sector having a first angular measurement of more than 90 degrees. The transition has a transition dimension that is less than the sidewall dimension.

In an example embodiment having one or more features of the connector of the previous paragraph, the shroud includes a third sidewall and a second transition between the second sidewall and the third sidewall in the form of a hollow cylindrical sector having a second angular measurement of more than 90 degrees. The second sidewall is transverse to the third sidewall. The third sidewall has the sidewall dimension, and the second transition has the transition dimension.

In an example embodiment having one or more features of the connector of any of the previous paragraphs, the first and second transitions are situated at corners of the shroud and the first and second transitions protrude beyond the first, second, and third sidewalls.

In an example embodiment having one or more features of the connector of any of the previous paragraphs, the first and second transitions include a radius of curvature and the first angular measurement is equal to the second angular measurement.

In an example embodiment having one or more features of the connector of any of the previous paragraphs, the first sidewall includes a first edge, the second sidewall includes a second edge, the first and second edges are at least partially in a first plane, the transition includes a third edge, and the third edge is at least partially in a second plane that intersects the first plane at an oblique angle.

In an example embodiment having one or more features of the connector of any of the previous paragraphs, the angle is between 60° and 20°, preferably between 50° and 30°, and more preferably 40°.

An illustrative example embodiment of a connector assembly includes a first connector including a first terminal and a first shroud surrounding the first terminal and a second connector including a second terminal configured to establish an electrically conductive connection with the first terminal. The second connector includes a second shroud surrounding the second terminal. The second shroud is configured to be received adjacent and overlapping with the first shroud when the first and second connectors are connected. The second shroud includes a first sidewall and a second sidewall that is transverse to the first sidewall. The second shroud includes a first transition between the first sidewall and the second sidewall in the form of a hollow cylindrical sector having a first angular measurement of more than 90 degrees. The first transition has a transition dimension that prevents contact between the transition and the at least one first terminal.

In an example embodiment having one or more features of the connector assembly of the previous paragraph, the first sidewall and the second sidewall have a sidewall dimension in a direction parallel to a connection direction of the terminals, the transition dimension is in the connection direction, and the transition dimension is less than the sidewall dimension.

In an example embodiment having one or more features of the connector assembly of any of the previous paragraphs, the shroud includes a third sidewall and a second transition between the second sidewall and the third sidewall in the form of a hollow cylindrical sector having a second angular measurement of more than 90 degrees, the second sidewall is transverse to the third sidewall, the third sidewall has the sidewall dimension, and the second transition has the transition dimension.

In an example embodiment having one or more features of the connector assembly of any of the previous paragraphs, the first and second transitions are situated at corners of the shroud and the first and second transitions protrude beyond the first, second, and third sidewalls.

In an example embodiment having one or more features of the connector assembly of any of the previous paragraphs, the first and second transitions include a radius of curvature and wherein the first angular measurement is equal to the second angular measurement.

In an example embodiment having one or more features of the connector assembly of any of the previous paragraphs, the first sidewall includes a first edge, the second sidewall includes a second edge, the first and second edges are at least partially in a first plane, the transition includes a third edge, and the third edge is at least partially in a second plane that intersects the first plane at an oblique angle.

In an example embodiment having one or more features of the connector assembly of any of the previous paragraphs, the angle is between 60° and 20°, preferably between 50° and 30°, and more preferably 40°.

The various features and advantages of at least one disclosed example embodiment will become apparent to those skilled in the art from the following detailed description. The drawings that accompany the detailed description can be briefly described as follows.

DETAILED DESCRIPTION

Figure 1:
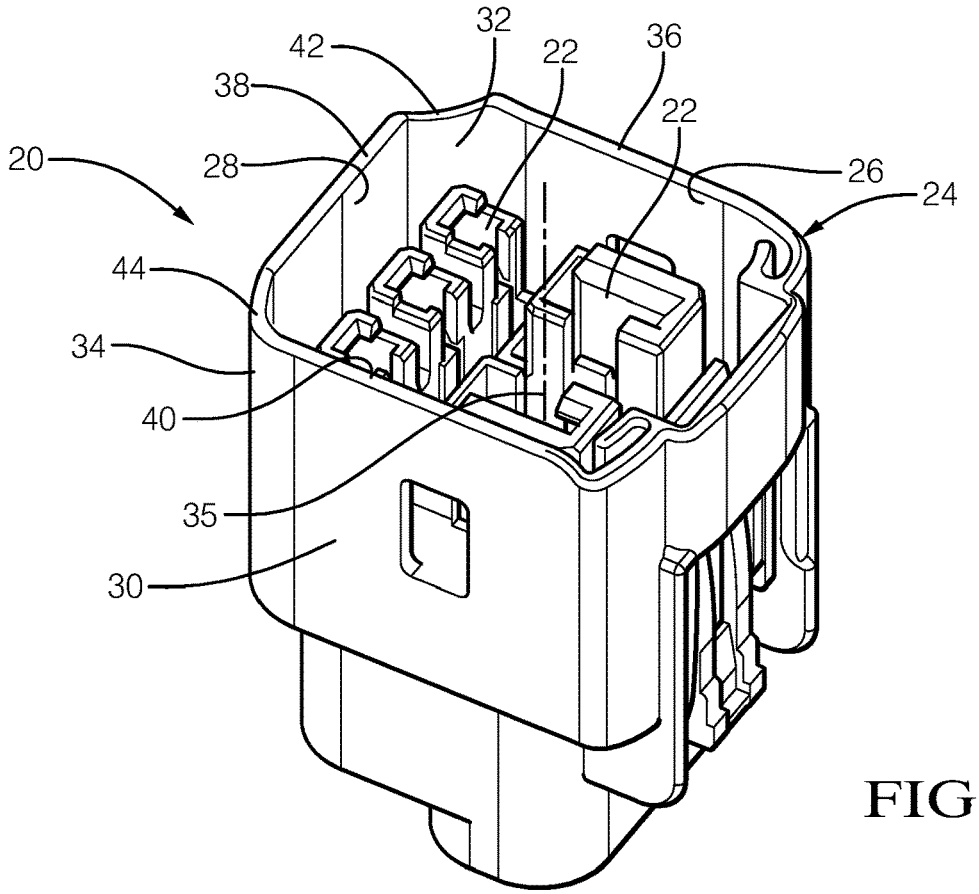
FIG. 1 is a perspective illustration of an example connector designed according to an embodiment of this invention.

FIG. 1 diagrammatically shows an example embodiment of a connector 20. A plurality of terminals 22 are configured to make an electrically conductive connection with another connector or device. The terminals 22 are surrounded by a shroud 24.

The shroud 24 includes a first sidewall 26 that is transverse to a second sidewall 28. A third sidewall 30 is transverse to the second sidewall 28 and parallel to the first sidewall 26. The shroud 24 includes transitions between the sidewalls. A first transition 32 is situated between the first sidewall 26 and the second sidewall 28. A second transition 34 is situated between the second sidewall 28 and the third sidewall 30. The shroud 24 is generally rectangular in the illustrated example embodiment and the transitions 32 and 34 have a radius of curvature having an angular measurement of more than 90 degrees so that the corners of the shroud 24 are rounded in the form of a hollow cylindrical sector.

Figure 2:
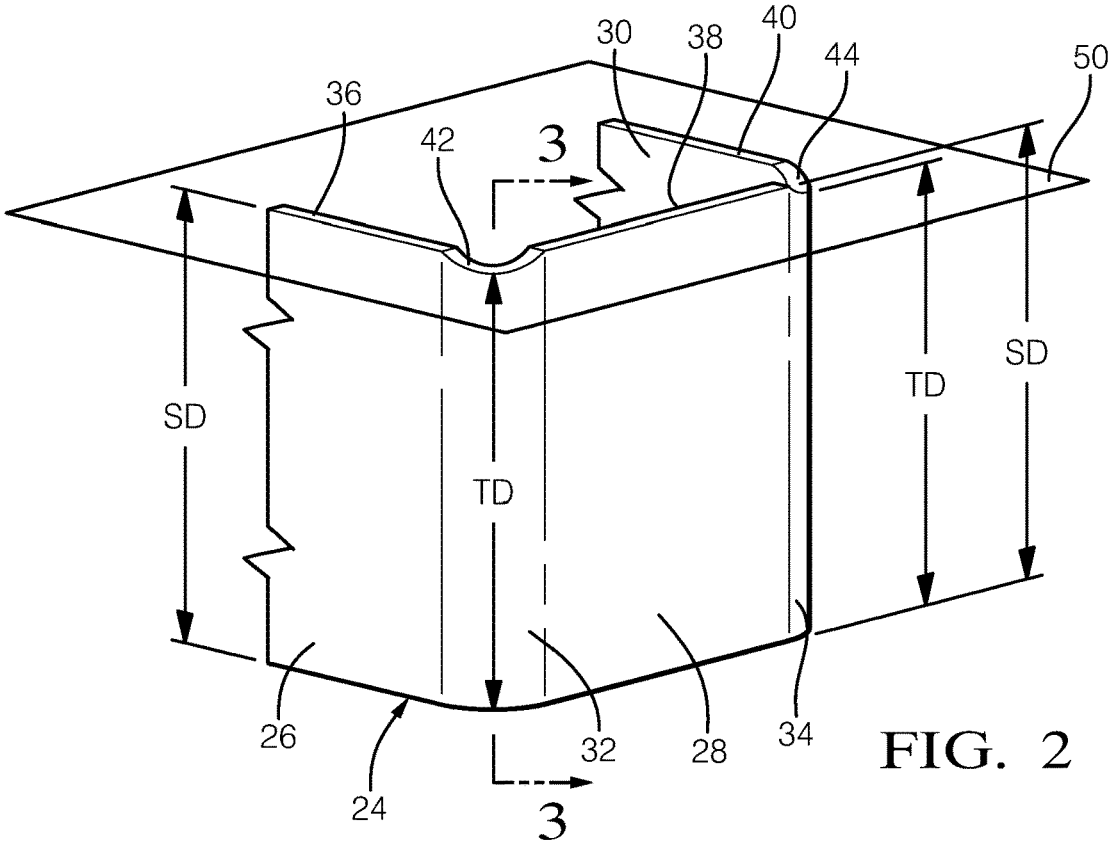
FIG. 2 shows selected features of the example connector.

Referring to FIGS. 1 and 2, the sidewalls 26, 28 and 30 have a sidewall dimension SD in a direction parallel to a longitudinal axis 35 of the terminals 22. The axis 35 extends in an insertion or connection direction along which relative movement between the connector 20 and an associated component facilitates making the desired connection. The transitions 32 and 34 have a transition dimension TD that is smaller than the sidewall dimension SD. The transition dimension TD is also defined in a direction parallel to the axis 35. From the perspective of FIG. 2, the sidewall dimension SD can be considered a height of each sidewall and the transition dimension TD can be considered a height of the transition. With smaller transition sections, the corners of the shroud 24 do not extend as far in the connection direction as the sidewalls 26, 28 and 30. The smaller transitions provide at least two features that are useful.

The inventors have discovered that the shape of the transitions 32 and 34 causes a material flow into a correspondingly shaped mold during an injection molding process that produces a shroud 24 that is less susceptible to warping of the sidewalls 26, 28, 30 compared to an alternative arrangement in which the transitions between the sidewalls are just as long or as large as the sidewalls in the connection direction. This is a particular benefit when the mold gate is located opposite the transitions 32, 34 in the mold. In an example embodiment, the shroud 24 is made of a glass filled nylon material. Reducing the likelihood of sidewall warping provides a better quality connector and reduces the likelihood of difficult connection with the connector 20.

In the illustrated example embodiment, the sidewall 26 includes an edge 36 at an open end of the shroud 24. The sidewall 28 includes an edge 38 and the sidewall 30 includes an edge 40. The transition 32 includes an edge 42 and a transition 34 includes an edge 44. The edges 36, 38 and 40 on the respective sidewalls are all situated in a reference plane 50 as schematically shown in FIG. 2. Given the smaller transition dimension TD compared to the sidewall dimension SD, the edges 42 and 44 are outside of the reference plane 50 (and below it in FIG. 2).

Figure 3:
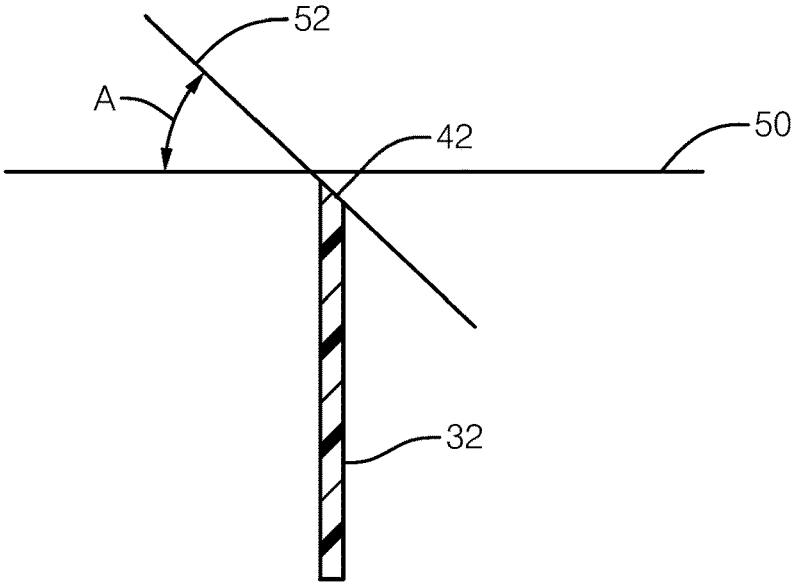
FIG. 3 shows selected features of the example connector from a sectional view taken along the lines 3-3 in FIG. 2.

The edges 42 and 44 include a surface that is situated within a reference plane 52 as shown in FIG. 3 that is at an oblique angle A relative to the reference plane 50. In the illustrated example embodiment, the angle A is between 20° and 60°. In some embodiments, the angle A is between 30° and 50°. According to one particular embodiment, the angle A is 40°.

Figure 4:
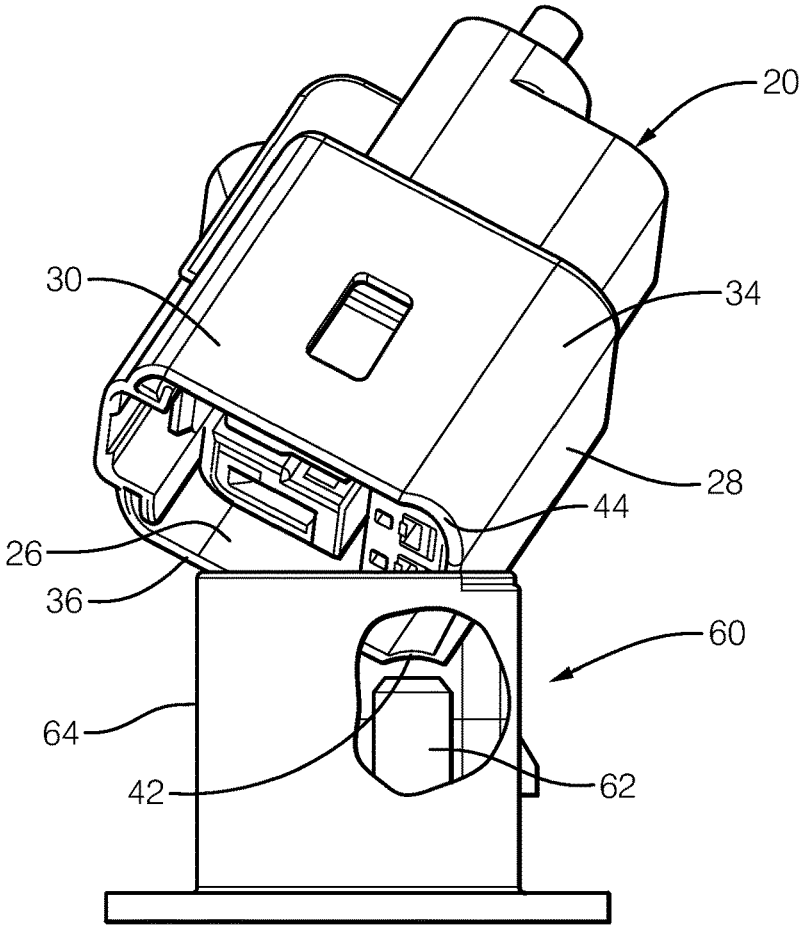
FIG. 4 diagrammatically illustrates an example connector assembly.

The smaller transition dimension TD and the angled orientation of the surfaces 42 and 44 reduce or eliminate a likelihood that the shroud 24 will undesirably contact a terminal on a connector or device to which the connector 20 is being coupled. FIG. 4 illustrates an example scenario in which a connector 60 is designed to be coupled with the connector 20. The connector 60 includes terminals 62 correspondingly shaped to mate with the terminals 22 of the connector 20. A shroud 64 surrounds the terminals 62. FIG. 4 shows the connectors 20 and 60 misaligned. When they are properly oriented for making a connection, the shrouds 64 and 24 are parallel to each other.

Even though a portion of the shroud 24 is able to penetrate into the space within the shroud 64 in the orientation shown in FIG. 4, the size of the transitions 32 and 34 prevent undesirable contact between the shroud 24 and the terminals 62. The transitions 32 and 34 are the portions of the shroud 24 that are most likely to penetrate the deepest into the shroud 64 when the connectors 20 and 60 are misaligned in a condition like that shown in FIG. 4. Having a smaller transition dimension TD avoids undesired contact between the shroud 24 and the terminals 62. This protects the integrity of the terminals 62.

The illustrated example connector 20 includes transitions 32 and 34 that are configured to avoid undesired contact with terminals on another connector or device. The relationship between the transitions 32 and 34 and the adjacent sidewalls 26, 28 and 30, also enhances the integrity and reliability of the shroud 24 by reducing or eliminating the likelihood of those sidewalls warping.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A connector, comprising:

a terminal configured to establish an electrically conductive connection with another component; and a shroud surrounding the terminal, the shroud including a first sidewall and a second sidewall that is transverse to the first sidewall, the first sidewall and the second sidewall having a sidewall dimension in a direction parallel to a longitudinal axis of the terminal, the shroud including a first transition between the first sidewall and the second sidewall in the form of a hollow cylindrical sector having a first angular measurement of more than 90 degrees, the first transition having a transition dimension that is less than the sidewall dimension, wherein the first sidewall includes a first edge that is perpendicular to the longitudinal axis of the terminal, the second sidewall includes a second edge that is perpendicular to the longitudinal axis of the terminal, and the first transition includes a third edge that is at an oblique angle relative to the longitudinal axis of the terminal, wherein the first edge and the second edge are parallel in a first plane and wherein the third edge is located outside the first plane.

2. The connector of claim 1, wherein the shroud includes a third sidewall and a second transition between the second sidewall and the third sidewall in the form of a hollow cylindrical sector having a second angular measurement of more than 90 degrees;

the second sidewall is transverse to the third sidewall;

the third sidewall has the sidewall dimension; and the second transition has the transition dimension.

3. The connector of claim 2, wherein the first and second transitions include a radius of curvature and wherein the first angular measurement is equal to the second angular measurement.

4. The connector of claim 1, wherein the oblique angle is between 60° and 20°.

5. The connector of claim 4, wherein the oblique angle is between 50° and 30°.

6. The connector of claim 5, wherein the oblique angle is 40°.

7. A connector assembly, comprising:

a first connector including a first terminal and a first shroud surrounding the first terminal; and a second connector including a second terminal configured to establish an electrically conductive connection with the first terminal when the second connector is aligned with the first connector along a connection direction, the second connector including a second shroud surrounding the second terminal, the second shroud including a first sidewall and a second sidewall that is transverse to the first sidewall, the second shroud including a first transition between the first sidewall and the second sidewall in the form of a hollow cylindrical sector, wherein the first sidewall includes a first edge;

the second sidewall includes a second edge;

the first and second edges are parallel and in a first plane;

the first transition includes a third edge; and the third edge is in a second plane that intersects the first plane at an oblique angle.

8. The connector assembly of claim 7, wherein the first transition has a transition dimension that prevents contact between the first transition and the first terminal when a portion of the second shroud including the first transition is at least partially situated in the first shroud while the second shroud is in an orientation that is non-parallel with the connection direction and wherein the first sidewall and the second sidewall have a sidewall dimension in a direction parallel to the connection direction of the first and second terminals, the transition dimension is in the connection direction, and the transition dimension is less than the sidewall dimension.

9. The connector assembly of claim 8, wherein the second shroud includes a third sidewall and a second transition between the second sidewall and the third sidewall in the form of a hollow cylindrical sector;

the second sidewall is transverse to the third sidewall;

the third sidewall has the sidewall dimension; and the second transition has the transition dimension.

10. The connector assembly of claim 9, wherein the first and second transitions include a radius of curvature and wherein a first angular measurement of the radius of curvature of the first transition is equal to a second angular measurement of the radius of curvature of the second transition.

11. The connector assembly of claim 7, wherein the angle is between 60° and 20°.

12. The connector assembly of claim 11, wherein the angle is between 50° and 30°.

13. The connector assembly of claim 12, wherein the angle is 40°.

14. A connector, comprising:

a terminal configured to establish an electrically conductive connection with another component; and a non-electrically conductive shroud surrounding the terminal, the shroud including a first sidewall and a second sidewall that is transverse to the first sidewall, the first sidewall and the second sidewall having a sidewall dimension in a direction parallel to a longitudinal axis of the terminal, the shroud including a first transition between the first sidewall and the second sidewall in the form of a hollow cylindrical sector, the first transition having a transition dimension in the direction parallel to the longitudinal axis that is less than the sidewall dimension, wherein the first sidewall includes a first edge that is perpendicular to the longitudinal axis of the terminal, the second sidewall includes a second edge that is perpendicular to the longitudinal axis of the terminal, and the first transition includes a third edge that is at an oblique angle relative to the longitudinal axis of the terminal.

15. The connector of claim 14, wherein the oblique angle is between 60° and 20°.

16. The connector of claim 15, wherein the oblique angle is between 50° and 30°.

17. The connector of claim 16, wherein the oblique angle is 40°.

18. The connector of claim 14, wherein the shroud includes a third sidewall and a second transition between the second sidewall and the third sidewall in the form of a hollow cylindrical sector;

the second sidewall is transverse to the third sidewall;

the third sidewall has the sidewall dimension;

the second transition has the transition dimension; and the first and second transitions each include a radius of curvature and an angular measurement that is greater than 90 degrees.

* * * * *